US007661412B2

(12) United States Patent
Kein et al.

(10) Patent No.: US 7,661,412 B2
(45) Date of Patent: Feb. 16, 2010

(54) METHOD OF CONTROLLING THE START-UP OF AN INTERNAL COMBUSTION ENGINE

(75) Inventors: Thibault Kein, Toulouse (FR); Laure Carbonne, Toulouse (FR)

(73) Assignee: Continental Automotive France, Toulouse (FR)

( * ) Notice: Subject to any disclaimer, the term of this patent is extended or adjusted under 35 U.S.C. 154(b) by 117 days.

(21) Appl. No.: 11/815,888

(22) PCT Filed: Feb. 7, 2006

(86) PCT No.: PCT/EP2006/001052

§ 371 (c)(1),
(2), (4) Date: Oct. 10, 2007

(87) PCT Pub. No.: WO2006/084660

PCT Pub. Date: Aug. 17, 2006

(65) Prior Publication Data

US 2008/0196697 A1 Aug. 21, 2008

(30) Foreign Application Priority Data

Feb. 9, 2005 (FR) ..... 05 01286

(51) Int. Cl.
*F02D 41/06* (2006.01)
*F02D 41/34* (2006.01)
*F02N 17/08* (2006.01)

(52) U.S. Cl. ..... 123/491; 123/179.16; 123/612

(58) Field of Classification Search ..... 123/491, 123/478, 480, 612, 179.16, 406.53, 406.58; 701/103–105, 113, 114
See application file for complete search history.

(56) References Cited

U.S. PATENT DOCUMENTS

| | | | | |
|---|---|---|---|---|
| 4,413,508 | A * | 11/1983 | Kawamura et al. | 73/114.26 |
| 4,732,122 | A | 3/1988 | Scarnera et al. | |
| 4,998,522 | A | 3/1991 | Achleitner et al. | |
| 5,156,125 | A * | 10/1992 | Fukui et al. | 123/406.62 |
| 5,184,590 | A * | 2/1993 | Hashimoto et al. | 123/406.58 |
| 5,647,322 | A * | 7/1997 | Fukui et al. | 123/406.18 |
| 5,758,625 | A | 6/1998 | Ponti | |
| 5,809,973 | A * | 9/1998 | Iida et al. | 123/491 |
| 5,957,107 | A * | 9/1999 | Kadota | 123/305 |
| 6,131,547 | A * | 10/2000 | Weber et al. | 123/406.58 |
| 6,202,634 | B1 * | 3/2001 | Siegl | 123/612 |
| 6,230,687 | B1 | 5/2001 | Marca | |
| 6,805,110 | B2 * | 10/2004 | Park | 123/609 |
| 6,827,063 | B2 * | 12/2004 | Breitegger et al. | 123/406.58 |
| 6,961,652 | B2 * | 11/2005 | Amano | 701/105 |
| 6,999,869 | B1 * | 2/2006 | Gitlin et al. | 701/115 |

(Continued)

FOREIGN PATENT DOCUMENTS

EP 0846852 5/2003

*Primary Examiner*—Stephen K Cronin
*Assistant Examiner*—Johnny H Hoang
(74) *Attorney, Agent, or Firm*—Young & Thompson

(57) ABSTRACT

A method of controlling the startup of an engine using a sensor having a reference index, commanding the rotation of the crankshaft, detecting the rotation of the crankshaft, selecting a group of cylinders for which the reference index is detected less than a half-turn of the crankshaft before the piston reaches the top dead center, before the inlet valves of the selected group of cylinders closes, commanding the injectors of the selected group of cylinders, detecting the reference index, and commanding the ignition element.

11 Claims, 3 Drawing Sheets

U.S. PATENT DOCUMENTS 7,000,598 B2 * 2/2006 Sheikh et al. ..... 123/476
7,185,628 B1 * 3/2007 Holm et al. ..... 123/319
7,373,928 B2 * 5/2008 Thomas ..... 123/491
2002/0157649 A1 * 10/2002 Zimmermann et al. ..... 123/478
2007/0277776 A1 * 12/2007 Thomas ..... 123/299

* cited by examiner

P1
P2
P3
P4
10
16
16a
16b
18
18a
18b
24
26
26a
26b
30
32

METHOD OF CONTROLLING THE START-UP OF AN INTERNAL COMBUSTION ENGINE

BACKGROUND OF THE INVENTION

The invention relates to a method of controlling the start-up of an indirect injection internal combustion engine.

The invention is more particularly intended for vehicles fitted with such an engine and will be described more precisely with reference to this application.

When the engine is stopped, the position of the engine and more precisely of the crankshaft is not generally known, at least with accuracy. It is however necessary to know this position in order to make the engine function correctly. In order to know this position, various methods have already been proposed, essentially consisting in rotating the crankshaft, injecting fuel at various times, reading various parameters by means of sensors and deducing the position of the engine from them.

SUMMARY OF THE INVENTION

The invention aims to reduce the time necessary to know the position of the engine and to make the engine function in a satisfactory manner, without generating pollution.

In order to do this, according to the invention, the following steps are carried out:

- an engine is used comprising:
  - a plurality of cylinders in each of which a piston slides between a bottom dead center and a top dead center,
  - a crankshaft whose rotational movement is linked with the sliding of the pistons,
  - inlet valves and exhaust valves moving between an open position and a closed position, each of the inlet valves and exhaust valves being associated with a cylinder,
  - inlet manifolds each associated with a cylinder with which they are connected by the intermediary of an inlet valve associated with said cylinder, and
  - injectors each associated with a cylinder for injecting fuel into the inlet manifold associated with said cylinder,
  - ignition means each associated with a cylinder for igniting the fuel contained in said cylinder,
- there is used a sensor comprising a fixed part and a target linked with the crankshaft, said target comprising a reference index detectable by the fixed part,
- a group of cylinders is selected for each of which cylinders the reference index is detected less than a half-turn of the crankshaft before the piston associated with it reaches the top dead center,
- the rotation of the crankshaft is commanded starting from a starting position of the engine,
- the rotation of the crankshaft is detected,
- before at least one of the inlet valves associated with the cylinders of the selected group of cylinders changes from the open position to the closed position, the injectors associated with the cylinders of the selected group of cylinders are commanded such that they inject fuel into the inlet manifolds associated with the cylinders of the selected group of cylinders,
- the reference index is detected,
- the ignition means associated with the cylinders of the selected group of cylinders are commanded at a time determined as a function of the detection of the reference index and substantially corresponding to the arrival at the top dead center of the pistons associated with the cylinders of the selected group of cylinders.

Thus, fuel is injected into the cylinders of the selected group before the inlet valves close for the first time. Consequently, the fuel is injected into the cylinders as early as possible. By injecting fuel only into these cylinders, knowledge of the position of the crankshaft is assured (possibly with an uncertainty of one turn of the crankshaft in the operating cycle), before having to ignite that fuel and consequently the obtaining of satisfactory combustion is ensured. The start-up time of the engine is therefore reduced without increasing pollution.

It is known by construction which are the cylinders for which the reference index is detected less than one half-turn of the crankshaft before the piston associated with it arrives at the top dead center. Consequently, the selected group of cylinders in which the first injection of fuel will be carried out will generally always be the same throughout the life of the engine.

According to one feature of the invention, advantageously in the case where an engine comprising four cylinders is used, commanding the injectors associated with the selected group of cylinders is stopped before the crankshaft has turned through 75 degrees with respect to the starting position of the engine.

It is known that the engine stops substantially in the middle, between two consecutive top dead centers, that a top dead center is reached every 180 degrees of rotation of the crankshaft in an engine with four cylinders and that for each of the cylinders the closing of the inlet valve occurs a little less than 180 degrees before the top dead center. Consequently, taking account of the uncertainty of the stopped position of the engine, the fuel injection is thus stopped before the inlet valve which was open in the starting position is closed again.

According to another feature of the invention, the target of the sensor is provided with a plurality of marks detectable by the fixed part and the rotation of the engine is detected by the detection of a certain number of marks consecutively.

In this way it is detected that the rotation of the engine is effective, unlike a sensor placed on the starter control button, and there is also assurance that it is not simply a jolt of the engine.

According to a complementary feature of the invention, the target of the sensor is provided with at least thirty marks detectable by the fixed part and the rotation of the engine is detected by the detection of 3 to 10 marks consecutively.

Thirty marks constitutes a minimum for detecting the rotation of the crankshaft sufficiently quickly. The detection of at least three marks is necessary to be sure that the rotation of the engine is destined to make it start up. Above ten marks, there is no longer any doubt in this matter.

According to another feature of the invention, the command for the injection of fuel into the inlet manifolds associated with the cylinders of the selected group of cylinders is stopped before at least one of the inlet valves associated with the cylinders of the selected group of cylinders changes from the closed position to the open position.

It is known that, for each of the cylinders, the exhaust valve is closed shortly after the opening of the inlet valve. Thus, fuel is prevented from being injected by an injector associated with a cylinder whose exhaust and inlet valves are both open.

BRIEF DESCRIPTION OF THE DRAWINGS

The invention will appear even more clearly in the following description, given with reference to the appended drawings in which.

DESCRIPTION OF THE PREFERRED EMBODIMENT

Figure 1:
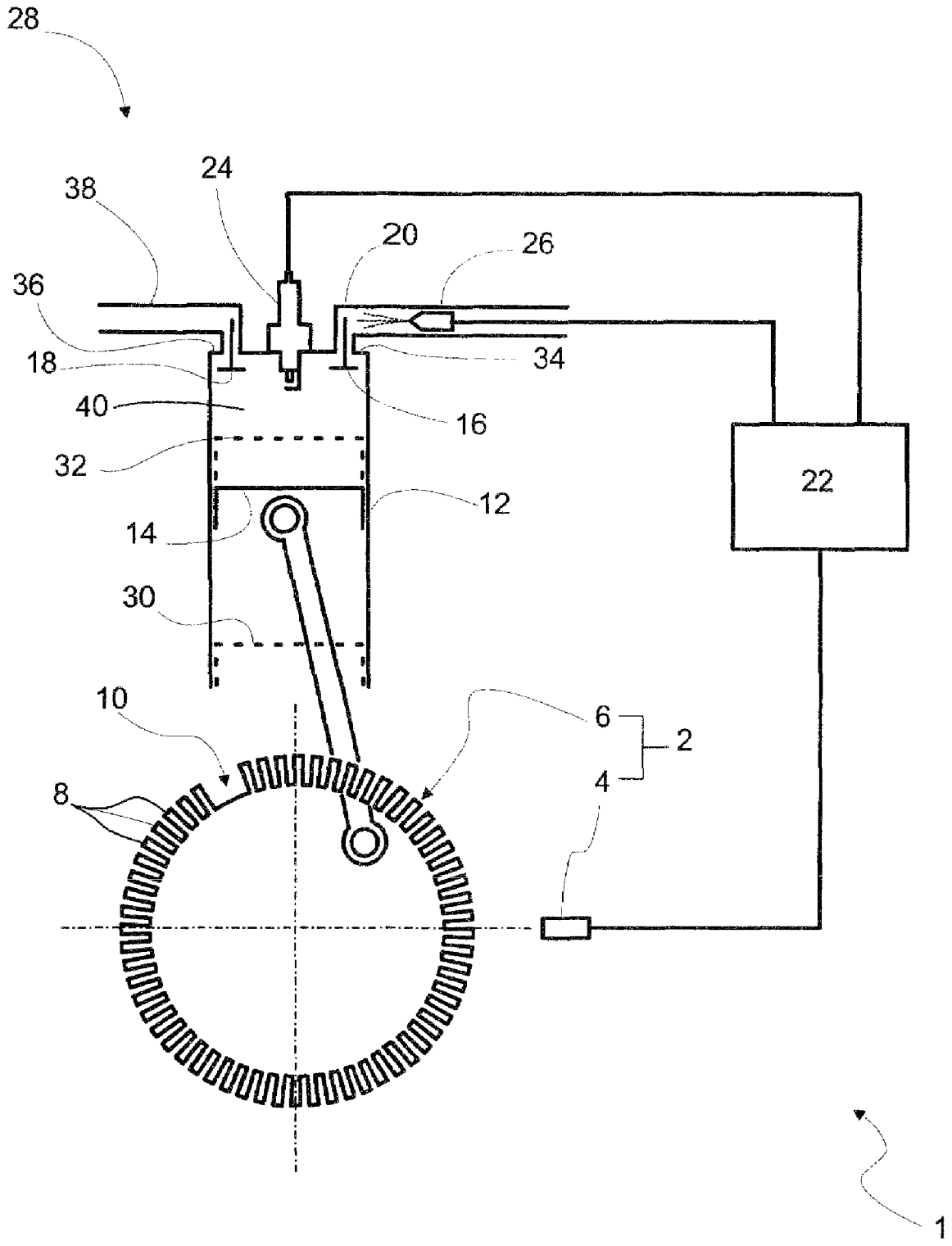
FIG. 1 is a diagrammatic representation of a device for implementing the method according to the invention.

FIG. 1 shows a device 1 essentially comprising an engine 28, a sensor 2 and a control unit 22.

The engine 28 here comprises four cylinders 12 (only one of which has been shown). For each of the cylinders 12, the engine comprises a piston 14, an inlet valve 16, an exhaust valve 18, an inlet manifold 20, an exhaust manifold 38, a sparking plug 24, an injector 26 and a combustion chamber 40.

Each piston 14 slides between a bottom dead center 30 and a top dead center 32, each shown in dotted line in the cylinder 12 to which it corresponds.

Each exhaust valve 18 moves between a closed position and an open position. In the closed position, the exhaust valve is bearing on its seat 36 and prevents any connection between the combustion chamber 40 and the exhaust manifold 38. On the other hand, when it is in the open position, the exhaust valve 18 is separated from its seat 36 and the combustion chamber 40 is then connected with the exhaust manifold 38.

Similarly, each inlet valve 16 moves between a closed position and an open position. In the closed position, the inlet valve is bearing on its seat 34 and prevents any connection between the combustion chamber 40 and the inlet manifold 20. On the other hand, when it is in the open position, the inlet valve 16 is separated from its seat 34 and the inlet manifold 20 is then connected with the combustion chamber 40.

Each one of the sparking plugs 24 is placed in the combustion chamber 40 of the corresponding cylinder and each injector 26 is placed in the inlet manifold 20 of the corresponding cylinder. The engine is thus of the "indirect" injection type because the injection does not take place directly into the combustion chamber. The sparking plugs 24 and the injectors 26 are controlled by the control unit 22.

The sensor 2 comprises a target 6 having 60 regularly distributed teeth 8 integral with the crankshaft and a fixed part 4 detecting the teeth 8 of the target 6. The teeth 8 constitute marks disposed every 6 degrees and separated by indentations. The target 6 more precisely comprises 58 teeth; two consecutive teeth have in fact been eliminated in order to constitute a reference index 10 making it possible to know the position of the crankshaft.

The fixed part 4 of the sensor 2 is connected to the control unit 22 which counts the number of teeth 8 detected by the sensor 2.

FIGS. 2A, 2B, 2C and 2D illustrate the teeth 8 detected by the sensor 2 during the rotation of the engine, above which is indicated the number of teeth 8 counted by the control unit 22. In these figures there is also marked, by a thick continuous line, for one of the cylinders 12, the period during which the injectors 26 are injecting fuel into the inlet manifold 20, the period during which the exhaust valve 18 is open and the period during which the inlet valve 16 is open and, by lightning flash, the time when the sparking plug 24 is energized.

As the engine has four cylinders, it substantially comprises four starting positions $P_1$, $P_2$, $P_3$ and $P_4$, each one positioned in the middle between a bottom dead center and the following top dead center, and vice-versa. These starting positions are those in which the engine naturally has a tendency to stop. There is an uncertainty of a few teeth about these starting positions.

Starting from the staring position $P_1$, the engine is driven in rotation by a starter (not shown). After the detection of five teeth 8 consecutively, in other words within a relatively short time such as 100 milliseconds, the control unit 22 considers that the engine is rotating for the purpose of its start-up. The engine control unit 22 therefore commands the injector 26 corresponding to the cylinder 12 considered in FIG. 2A. The sensor 2 detects six teeth 8 between the start 26*a* and the end 26*b* of fuel injection.

The fuel injection stops after a rotation of 66 degrees of the crankshaft starting from the starting position $P_1$ and generally before the opening 16*a* of the inlet valve 16, despite the uncertainty of the starting position. In this case, the opening 16*a* of the inlet valve 16 takes place after the detection by the sensor 2 of two other teeth 8, that is to say 78 degrees starting from the starting position $P_1$. After that the fuel injected into the inlet manifold 20 enters into the combustion chamber 40.

The piston 14 reaches the top dead center 32 after rotation of the crankshaft by two other teeth 8, that is to say 12 degrees. Then, after rotation of the crankshaft by another two teeth 8, the closing 18*b* of the exhaust valve 18 takes place.

No reference index 10 having yet been detected, the position of the crankshaft is not yet known by the control unit 22.

The crankshaft continues to rotate, the piston 14 reaches the bottom dead center 30 and then, after detection of three teeth 8, the reference index 10 is detected by the sensor 2. The engine control unit 22 then knows the position of the crankshaft and can command the energizing of the sparking plug 24 after the detection of twenty four teeth 8 by the sensor 2, Meanwhile (three teeth 8 after the arrival of the piston 14 at the bottom dead center 30), the closing 16*b* of the inlet valve 16 takes place.

The combustion of the fuel in the combustion chamber 40 therefore starts one tooth 8 (6 degrees) before the arrival of the piston 32 at the top dead center 32 and about 1¼ turn of the crankshaft after the starting position $P_1$.

Figures 2A, 2B, 2C, 2D:
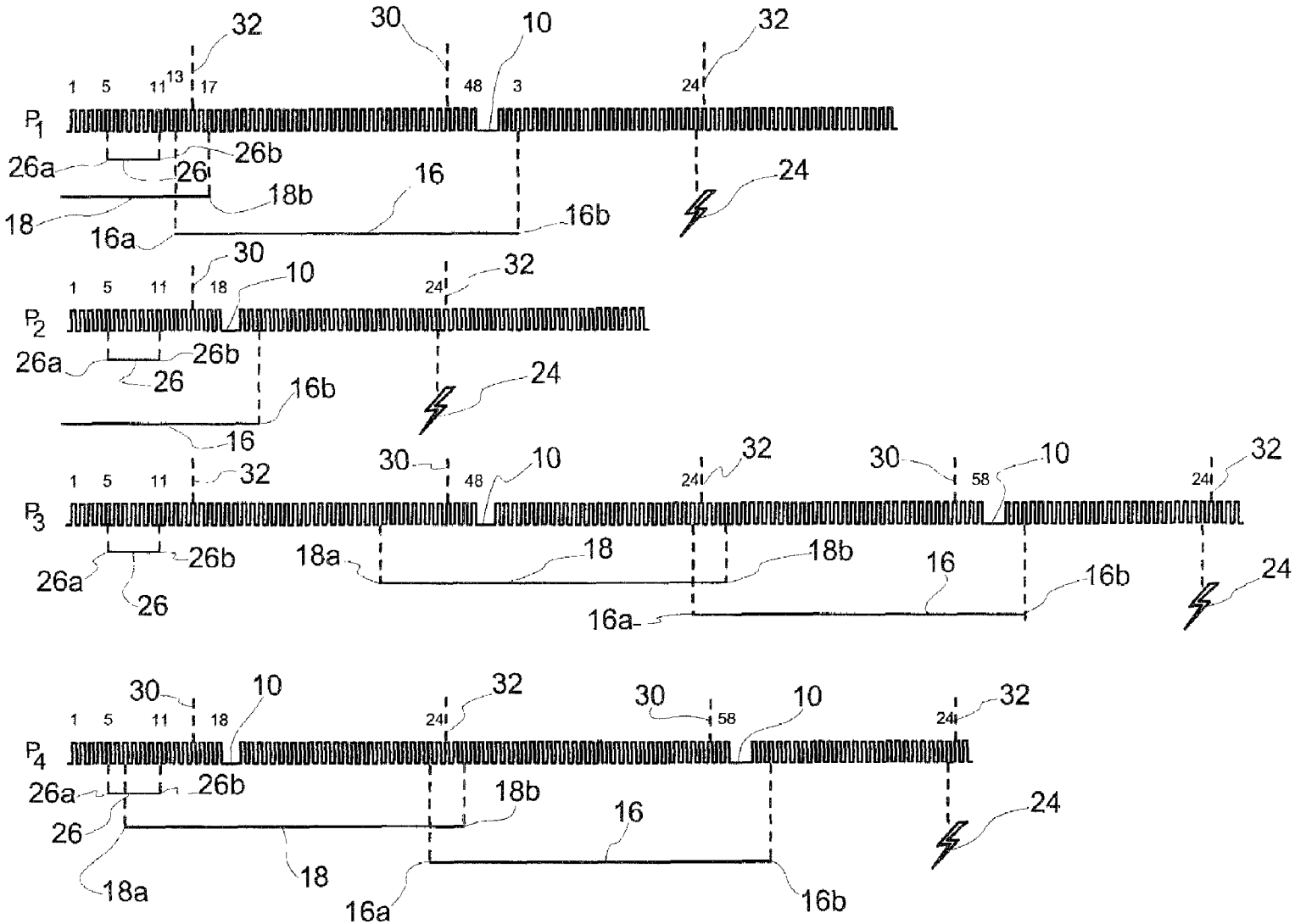
FIGS. 2A, 2B, 2C and 2D represent a method according to the invention starting from four different starting points.

FIG. 2B illustrates the start-up of the engine starting from the starting position $P_2$, offset by one half-turn of the crankshaft with respect to the starting position $P_1$.

As described above, starting from the starting position $P_2$, the engine is driven in rotation by a starter. After the detection of five teeth 8, the engine control unit 22 commands the injector 26 corresponding to the cylinder 12 considered in FIGS. 2A, 2B, 2C and 2D.

The injection 26 of fuel into the inlet manifold 20 takes place whilst the crankshaft is rotating by six teeth 8.

In this case, the injection 26 of fuel occurs entirely whilst the exhaust valve 18 is closed and the inlet valve 16 is open. The injected fuel therefore enters directly into the combustion chamber 40.

Shortly after (about four teeth 8, that is to say 24 degrees of rotation of the crankshaft) the end 26*b* of fuel injection 26, the piston 14 reaches the bottom dead center 30. Then, as mentioned before, the reference index 10 is detected, the inlet valve 16 is closed and then the control unit 22 commands the sparking plug 24.

The energizing of the sparking plug 24 and the combustion of the fuel in the combustion chamber 40 which follows therefore takes place substantially three quarters of a turn after the starting position $P_2$.

FIG. 2C illustrates the start-up of the engine starting from the starting position $P_3$, offset by one turn of the crankshaft with respect to the starting position $P_1$.

After the detection of five teeth 8, starting from the starting position $P_3$, the engine control unit 22 commands the injector 26 corresponding to the cylinder 12 considered in FIGS. 2A, 2B, 2C and 2D.

The injection 26 of fuel into the inlet manifold 20 takes place whilst the crankshaft is rotating by six teeth 8.

In this case, the injection 26 of fuel takes place entirely whilst the exhaust valve 18 and the inlet valve 16 are closed.

Then, the piston 14 reaches the top dead center 32, the opening 18*a* of the exhaust valve 18 occurs, the piston 14 reaches the bottom dead center 30, the reference index 10 is detected, the opening 16*a* of the inlet valve 16 occurs and the fuel enters the combustion chamber 40, the piston 14 teaches the top dead center 32, the closing 18*b* of the exhaust valve 18 takes place, the piston reaches the bottom dead center 30, the reference index 10 is detected a second time (after detection of fifty eight teeth 8), the closing 16*b* of the inlet valve 16 takes place and finally the energizing of the sparking plug 24 is commanded by the control unit 22.

The combustion of the fuel in the combustion chamber 40 therefore takes place substantially 2¼ turns of the crankshaft after the starting position $P_3$.

FIG. 2D illustrates the start-up of the engine starting from the starting position $P_4$, offset by one turn of the crankshaft with respect to the starting position $P_2$.

After detection of five teeth 8, starting from the starting point $P_4$, the engine control unit 22 commands the injector 26 corresponding to the cylinder 12 considered in FIGS. 2A, 2B, 2C and 2D.

The injection 26 of fuel takes place entirely whilst the inlet valve 16 is closed and the combustion of the fuel in the combustion chamber 40 occurs substantially 1¾ turns of the crankshaft after the starting position $P_4$.

In order to start-up the engine faster, before the first combustion, it is possible to inject fuel simultaneously for all of the cylinders for which the reference index 10 is detected less than one half-turn of the crankshaft before the position 14 associated with it reaches the top dead center 32, in other words, in half of the cylinders.

In the present case, the fuel is injected simultaneously into another cylinder, which is offset by one turn of the crankshaft with respect to the cylinder considered in FIGS. 2A, 2B, 2C and 2D.

Thus, less than a quarter of a turn of the crankshaft after the starting position, fuel is injected simultaneously into the inlet manifold of a cylinder whose starting position is the position $P_1$ and into the inlet manifold of a cylinder whose starting position is the position $P_3$, or into the inlet manifold of a cylinder whose starting position is the position $P_2$ and into the inlet manifold of a cylinder whose starting position is the position $P_4$. The fuel injections into the inlet manifolds of the other two cylinders can be offset by one half-turn of the crankshaft in order to ensure combustion in each engine cycle.

The first combustion therefore takes place either three quarters of a turn of the crankshaft after the starting position, that is to say 1¼ turns of the crankshaft after the starting position.

The invention is of course in no way limited to the embodiment which has just been described as a non-limiting example. Thus, other means could be provided for detecting the rotation of the engine, for example by analysing the magnitude of the current flowing through the starter.

The invention claimed is:

1. A method of controlling the startup of an indirect injection internal combustion engine (28), said indirect injection internal combustion engine comprising:

a plurality of cylinders (12), a piston (14) in each of said cylinders sliding between a bottom dead center (30) and a top dead center (32), a crankshaft whose rotational movement is linked with the sliding movement of each of the pistons (14), an inlet valve (16) and an exhaust valve (18) moving between an open position and a closed position, and being associated with each of the cylinders (12), an inlet manifold (20) associated with said each of the cylinders (12) and connected by an intermediary of said inlet valve (16) associated with said each of the cylinders, and an injector (26) associated with said each of the cylinders (12) for injecting fuel into the inlet manifold associated with said each of the cylinders, ignition means (24) associated with said each of the cylinders (12) for igniting the fuel contained in said each of the cylinders (12), a crankshaft position sensor (2) comprising a fixed part (4) and a target (6) linked with the crankshaft, said target comprising a reference index (10) detectable by the fixed part (4), said method comprising the following steps:

commanding starting of the rotation of the crankshaft from a starting position ($P_1$, $P_2$, $P_3$, $P_4$) of the engine, detecting the rotation of the crankshaft, selecting a group of cylinders and for each of the selected group of cylinders, detecting the reference index (10) less than a half-turn of the crankshaft before the piston (14) associated with it reaches the top dead center (32), commanding the injectors (26) associated with the selected group of cylinders such that the injectors finish injecting fuel into the inlet manifolds (20) associated with the selected group of cylinders before the crankshaft has turned through 75 degrees with respect to the starting position ($P_1$, $P_2$, $P_3$, $P_4$) of the engine, such that at least one of the inlet valves (16) associated with the selected group of cylinders changes (16*b*) from the open position to the closed position, detecting the reference index (10), commanding the ignition means (24) to ignite said each of the selected cylinders at a time determined as a function of the detecting of the reference index (10) and substantially corresponding to an arrival at the top dead center (32) of the piston (14) associated with igniting said each of the selected cylinders, wherein said method is free of any use of a camshaft position sensor.

2. The method as claimed in claim 1, wherein the target (6) of the sensor (2) is provided with a plurality of marks (8) detectable by the fixed part (4) and the detecting the reference index comprises consecutively detecting a certain number of the marks (8).

3. The method as claimed in claim 2, wherein the target (6) of the sensor is provided with at least thirty marks (8) detectable by the fixed part (4) and the rotation of the engine is detected by the detection of 3 to 10 marks consecutively.

4. The method as claimed in claim 1, wherein said step of commanding the injectors comprises issuing a command for the injection (26) of fuel and stopping the issuing of the command before at least one of the inlet valves (16) of the selected group of cylinders changes (16*a*) from the closed position to the open position.

5. The method as claimed in claim 1, wherein the engine (28) comprising four cylinders, and said step of commanding the injectors (26) is stopped before the crankshaft has turned through 75 degrees with respect to the starting position ($P_1$, $P_2$, $P_3$, $P_4$) of the engine.

6. The method as claimed in claim 2, wherein said step of commanding the injectors is stopped before at least one of the inlet valves (16) of the selected group of cylinders changes (16*a*) from the closed position to the open position.

7. The method as claimed in claim 3, wherein said step of commanding the injectors is stopped before at least one of the inlet valves (16) of the selected group of cylinders changes (16*a*) from the closed position to the open position.

8. The method as claimed in claim 2, wherein the engine (28) comprising four cylinders, and said step of commanding the injectors (26) is stopped before the crankshaft has turned through 75 degrees with respect to the starting position ($P_1$, $P_2$, $P_3$, $P_4$) of the engine.

9. The method as claimed in claim 3, wherein the engine (28) comprising four cylinders, and said step of commanding the injectors (26) is stopped before the crankshaft has turned through 75 degrees with respect to the starting position ($P_1$, $P_2$, $P_3$, $P_4$) of the engine.

10. The method as claimed in claim 1, wherein the engine (28) comprising four cylinders, and said step of commanding the injectors (26) is stopped before the crankshaft has turned through 75 degrees with respect to the starting position ($P_1$, $P_2$, $P_3$, $P_4$) of the engine.

11. A method of controlling the startup of an indirect injection internal combustion engine (28), said indirect injection internal combustion engine comprising:

a plurality of cylinders (12), a piston (14) in each of said cylinders sliding between a bottom dead center (30) and a top dead center (32), a crankshaft whose rotational movement is linked with the sliding movement of each of the pistons (14), an inlet valve (16) and an exhaust valve (18) moving between an open position and a closed position, and being associated with each of the cylinders (12), an inlet manifold (20) associated with said each of the cylinders (12) and connected by an intermediary of said inlet valve (16) associated with said each of the cylinders, and an injector (26) associated with said each of the cylinders (12) for injecting fuel into the inlet manifold associated with said each of the cylinders, ignition means (24) associated with said each of the cylinders (12) for igniting the fuel contained in said each of the cylinders (12), a crankshaft position sensor (2) comprising a fixed part (4) and a target (6) linked with the crankshaft, said target comprising a reference index (10) detectable by the fixed part (4), said method comprising the following steps:

commanding starting of the rotation of the crankshaft from a starting position ($P_1$, $P_2$, $P_3$, $P_4$) of the engine, detecting the rotation of the crankshaft, selecting a group of cylinders and for each of the selected group of cylinders, detecting the reference index (10) less than a half-turn of the crankshaft before the piston (14) associated with it reaches the top dead center (32), commanding the injectors (26) associated with the selected group of cylinders such that the injectors finish injecting fuel into the inlet manifolds (20) associated with the selected group of cylinders before the crankshaft has turned through 75 degrees with respect to the starting position ($P_1$, $P_2$, $P_3$, $P_4$) of the engine, such that at least one of the inlet valves (16) associated with the selected group of cylinders changes (16*b*) from the open position to the closed position, detecting the reference index (10), commanding the ignition means (24) to ignite said each of the selected cylinders at a time determined as a function of the detecting of the reference index (10) and substantially corresponding to an arrival at the top dead center (32) of the piston (14) associated with igniting said each of the selected cylinders, wherein the crankshaft position sensor is the only position sensor used by said method.

* * * * *

UNITED STATES PATENT AND TRADEMARK OFFICE

CERTIFICATE OF CORRECTION

Figure 3:
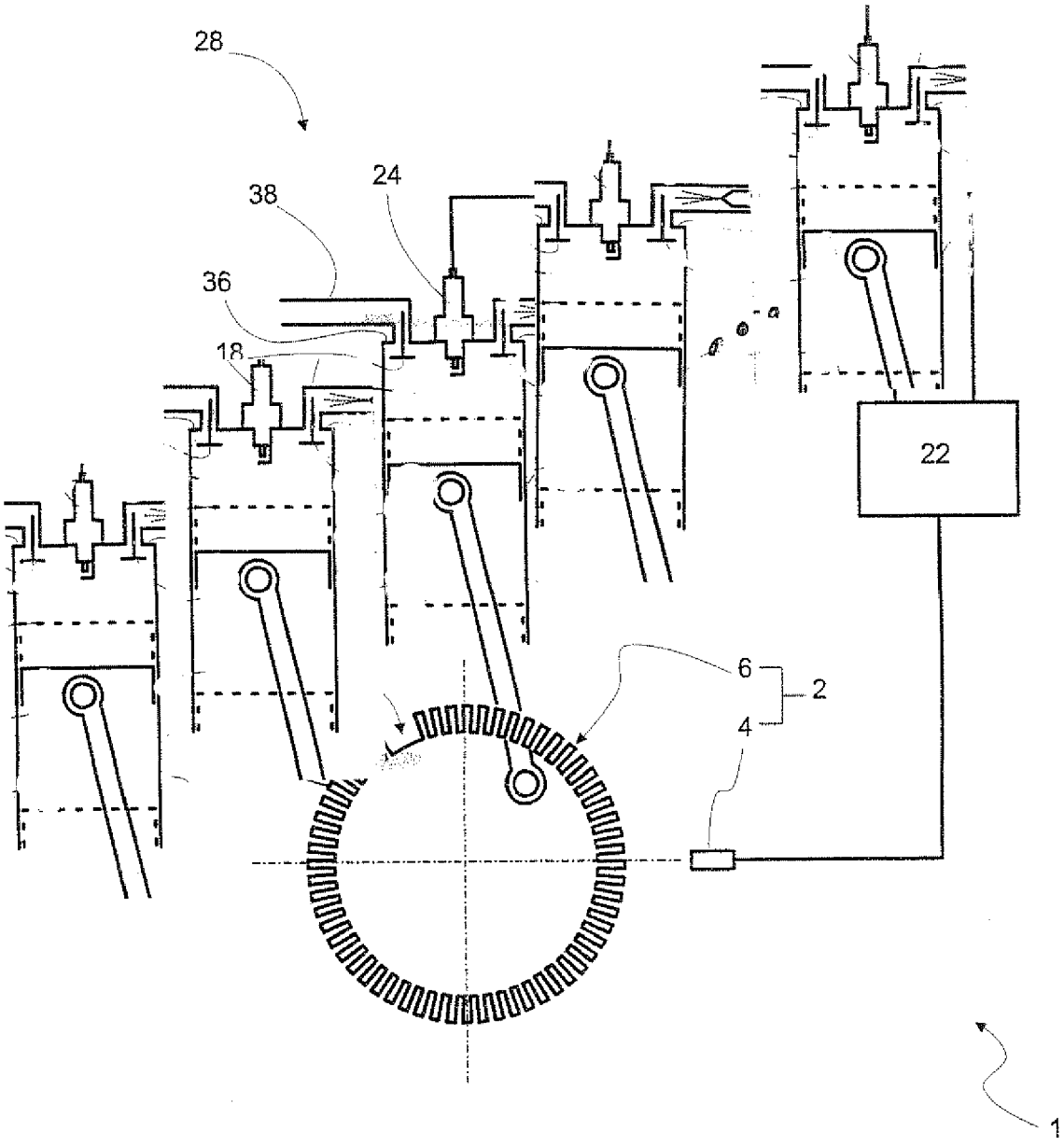
FIG. 3 illustrates a group of cylinders.
Figure 3:
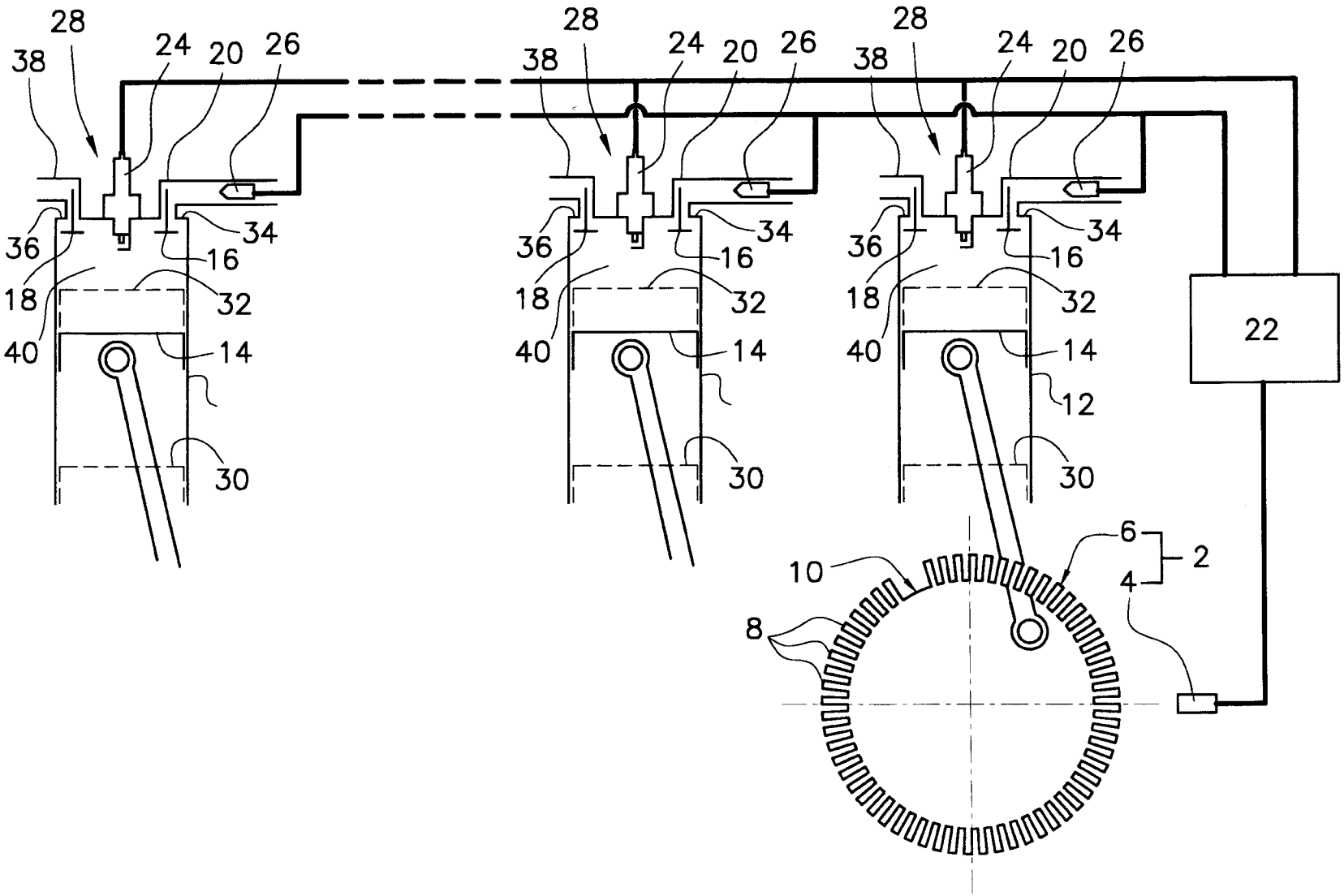

PATENT NO. : 7,661,412 B2
APPLICATION NO. : 11/815888
DATED : February 16, 2010
INVENTOR(S) : Laure Carbonne and Thibault Kein It is certified that error appears in the above-identified patent and that said Letters Patent is hereby corrected as shown below:

In the drawings Fig. 3 should be replaced with the corrected Fig. 3 as shown on the attached page.

Signed and Sealed this
Twenty-sixth Day of June, 2012

David J. Kappos

David J. Kappos
*Director of the United States Patent and Trademark Office*